United States Patent [19]

Bassett

[11] 4,019,045

[45] Apr. 19, 1977

[54] SOCKET MOUNTING CAP

[75] Inventor: Norman W. Bassett, Anderson, Ind.

[73] Assignee: General Motors Corporation, Detroit, Mich.

[22] Filed: Aug. 25, 1975

[21] Appl. No.: 607,254

[52] U.S. Cl. ..... 240/41 BM; 240/41 L; 339/127 R

[51] Int. Cl.² ..... F21M 7/00

[58] Field of Search ..... 240/41 L, 41 R, 41 BM, 240/8.3, 52.1; 339/60 R, 127 R, 128, 176 L, 94 A, 99 L

[56] References Cited

UNITED STATES PATENTS

| | | | |
|---|---|---|---|
| 2,233,486 | 3/1941 | Portnow | 240/41 R |
| 2,274,178 | 2/1942 | Wood | 240/41 BM X |
| 3,649,955 | 3/1972 | Schmidt et al. | 339/127 R X |

*Primary Examiner*—L. T. Hix
*Assistant Examiner*—Kenneth C. Hutchison
*Attorney, Agent, or Firm*—J. C. Evans

[57] ABSTRACT

A lamp housing and socket assembly includes an injected molded plastic housing with an integral, axially outwardly directed collar and a radially inwardly directed light interception surface with a bulb access opening slightly larger in diameter than the maximum diameter of a bulb supported in a lamp socket; the lamp socket includes a plurality of locking ears on one end thereof and a sealing gasket; a standard socket mounting cap is supported on the collar to define a socket mount that can be universally used with mirrors having a range of focal lengths. The socket mounting cap includes an inboard flange supported on the outer periphery of the mirror collar and a large diameter outboard flange that shields the gasket; and the cap further includes a radially inwardly directed socket opening wall for receiving the locking ears for rotation with respect thereto to secure the socket and the lamp with respect to the housing; the arrangement minimizing socket hole light reflection losses thereby to minimize the light size requirements for producing a desired light output from the assembly.

3 Claims, 4 Drawing Figures

SOCKET MOUNTING CAP

This invention relates to lamp socket and housing assemblies and more particularly to such assemblies with molded housing parts including a lamp access opening therein.

In order to facilitate placement of lamps in a vehicle lamp housing, it is desirable to include a lamp socket as an integral part of a wiring harness. In such cases, the socket includes locking ears thereon that are axially insertable through a socket hole and rotatable with respect thereto to secure the bulb in an accurate relationship to a refracting lens or light reflecting surface on the lamp housing. An example of such a lamp socket is illustrated in U.S. Pat. No. 3,559,152 issued Jan. 26, 1971, to W. Pearce, Jr. In order to positively seal the joint between the socket and the lamp housing, a separate seal gasket is located on the socket at a point outboard thereof. As a further feature, and especially in cases where the socket is exposed to extreme ambient conditions, including direct exposure to water and the like, it has been proposed to include an annular flange or mud shield on the housing located in radially outward surrounding relationship with the gasket to shield the gasket from dirt and the like. In order to provide an integral mud shield on present day molded housings, it is necessary to integrally form a substantial region of plastic material on the housing at a bulb access opening therein. This can require an extended molding time cycle. Further, in such cases, relatively undesirable sinks can occur in the mold material. Furthermore, in such cases, it is necessary to configure the core side of a socket pocket with parallel walls. This substantially increases the socket hole or bulb access opening area in the lamp housing to cause excessive loss of reflector efficiency. As a result the unit must be increased in size to produce sufficient illumination for a given lamp housing device.

Accordingly, an object of the present invention is to provide an improved lamp socket and lamp housing assembly for accurately locating an electrically energized filament of a lamp at the focal point of a molded lamp housing reflector having an integrally formed, outwardly extending collar socket forming pocket thereon and a radially inwardly directed integrally formed light interception surface thereon which permits separation of the housing mold without increasing bulb access opening area and wherein a socket mounting cap has an inboard flange secured to the collar and an outboard flange of larger diameter thereof joined at a radially inwardly directed reference wall against which a sealing gasket is located to position a bulb filament at the focal point and wherein the radially inwardly directed light interception surface defines a bulb access opening slightly greater than the maximum outside diameter of the bulb so as to minimize the percentage of socket hole light loss from the lamp thereby to increase the efficiency of light emission from the lamp housing.

Still another object of the present invention is to provide an improved lamp socket and housing support assembly for association with a standard vehicle lamp socket having a plurality of locking or retention ears on one end thereof and an adjacent sealing gasket and wherein the socket has a lamp with a predetermined outside diameter; by the provision of an integrally molded lamp housing having a parabolic surface inboard thereof with a predetermined focal length and including an outboard annular collar thereon with a socket mounting cap secured thereto including a radially inwardly directed socket opening wall for receiving the locking ears for rotation with respect thereto to secure the socket on the cap and wherein the cap further includes a large diameter outboard flange thereon located in surrounding relationship with the gasket in abutment with the socket hole wall to define an axial reference distance to accurately locate the lamp filament at the focal point and wherein the lamp housing includes a radially inwardly directed lamp bulb access opening therein of a diameter slightly greater than that of the greatest diameter of the bulb to define an annular light intercept region that reduces the percentage of lamp housing hole loss from the lamp to improve the efficiency of light emissions from the lamp housing.

Yet another object of the present invention is to provide an improved method for reducing bulb access opening losses from a lamp housing reflector including the steps of forming a bulb access opening in the parabolic mirror having a diameter no greater than 10 percent more than the maximum outside diameter of the bulb, forming an integrally formed extension collar on the housing extending outwardly therefrom and mounting a preformed socket support cap on the outer end of the extension to define an axial reference surface that will supportingly receive a socket to locate a bulb filament at a constant light center length so as to locate the bulb filament at a focal point of the mirror, and forming the light interception surface on the reflector to intercept a generated cone of light from the bulb filament to prevent excessive socket area light loss from the reflector.

Further objects and advantages of the present invention will be apparent from the following description, reference being had to the accompanying drawings wherein a preferred embodiment of the present invention is clearly shown.

Figure 1:
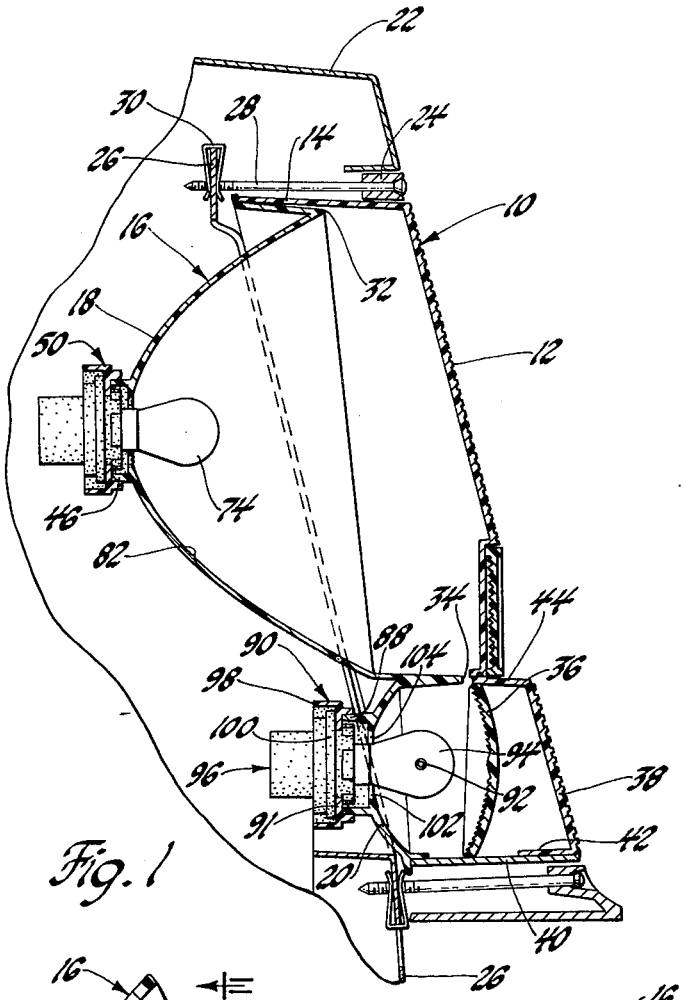
FIG. 1 is a vertical sectional view of a lamp housing including the improved socket support of the present invention.

Referring now to the drawings, in FIG. 1 a lamp housing assembly 10 is illustrated. It includes a forwardly located lens 12 having a peripheral wall 14 secured to an injection molded plastic rear housing wall 16 including a first parabolic mirror or reflector 18 thereon and a second parabolic mirror or reflector 20 independent therefrom. The housing assembly 10 is secured within a support member 22 by means of a bezel 24 secured to a wall segment 26 of the support member 22 by suitable fastening means representatively illustrated as a plurality of elongated screws 28 directed through the bezel 24 into threaded engagement with a retainer element 30 snap fit over an edge of the wall segment 26.

The rear housing wall 16 is formed by mold parts that separate through an open end 32 of the parabolic mirror 18 and an open end 34 of the parabolic mirror 20. The open end 34 is closed by a lens 36 which is covered by a light transmitting lamp housing cover 38 secured to a horizontally disposed support member 40 at a first rearwardly directed flange 42 on cover 38 and to the lens 12 by a second rearwardly directed flange 44 on cover 38.

In accordance with certain principles of the present invention, each of the injection molded parabolic mirrors 18, 20 on the rer housing wall 16 includes an integrally formed rearwardly directed collar thereon which is associated with means to accurately locate a combination socket and lamp assembly accurately with respect to the focal point of the injection molded housing wall 16. The socket is characterized by having a sealing gasket thereon. In the past, an integral mud shield was formed on a rear housing wall to shield the gasket against dirt and the like. This mud shield function required that the inside diameter of the outer collar be increased to a point where the bulb access opening in the parabolic mirror component of an injection molded reflector be increased in size to draw molds. This produced a resultant loss of reflected light from the vicinity of the bulb access hole.

In the design of parabolic reflectors, it is recognized that as the reflector focal length decreases and the diameter of the socket support increases that there can be a substantial loss of reflection from the vicinity of the socket support on the reflector. For example, in the case of a two inch diameter loss, at the socket support in a parabolic reflector with a focal length of 1.250 inches, approximately 14 percent of the radiated light from the filament is lost at the socket hole by elimination of reflector surface from the reflecting area of the parabolic reflector at this point. Similarly, in the case of a 1.4 inch diameter loss at the socket support in a parabolic reflector having a reflector focal length of 1.250 inches, 7 percent socket hole loss is observed.

The present invention is adapted for association with the type of socket and bulb assembly wherein the bulb is in place in the socket and secured to the housing to locate filaments therein at an accurate location with respect to the lens components of the housing and at an accurate relationship with the focal point of the parabolic mirror or reflector. In order to achieve this relationship and retain a mud shield collar or flange on the parabolic mirror, it has been necessary to configure the collar to have substantially parallel walls thereby increasing the socket hole area and producing an undesirable loss in lamp efficiency.

In accordance with the present invention, the rear housing wall 16 of the assembly is configured to minimize socket hole losses from the parabolic mirrors 18, 20.

Figure 2:
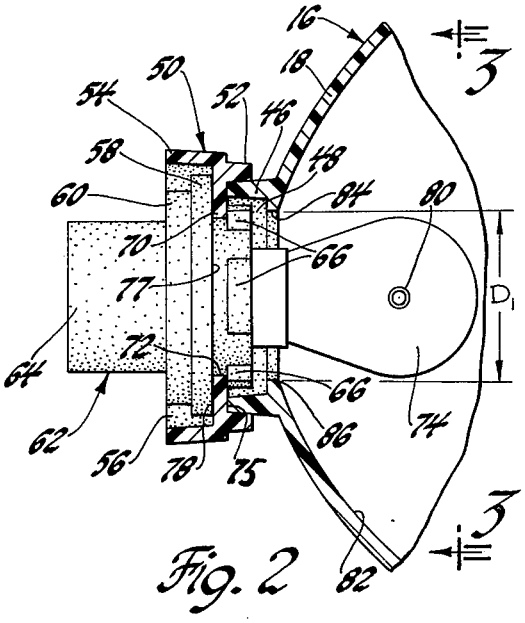
FIG. 2 is an enlarged sectional view of a socket support and light reflector assembly of the present invention.

More particularly, an annular collar 46 is integrally formed on the parabolic mirror 18. It extends axially rearwardly thereof to define a socket pocket region 48 outwardly of the mirror 18. The length of the collar 46 is preselected for association with a standardized socket mounting cap 50 constructed in accordance with the present invention to define a reference surface which in accordance with the preselected length of the collar 46 will establish a light center length to locate the bulb filament at the focal point of the reflector or mirror 18. More particularly, as shown in FIG. 2, the cap 50 includes an annular inboard flange 52 supported on the outer periphery of the collar 46 where it is fixedly secured. The cap 50 further includes an annular outboard flange 54 thereon having an inside diameter to define a cavity 56 of a diameter greater than that of a sealing gasket 58 on an annular flange portion 60 of a combination socket bulb assembly 62.

The socket bulb assembly 62 is of the type having an integral wiring harness secured thereto at a terminal block 64 thereon. It further includes on its opposite end, a plurality of radially ourwardly directed circumferentially spaced locking ears or tabs 66 that are axially insertable through a plurality or circumferentially spaced radially outwadly located slots 68 formed in a socket support wall 70 integrally formed with and directed radially inwardly of the cap 50 intermediate the flanges 52, 54 thereon. The wall 70 includes a circular opening 72 therein through which a bulb 74 of the socket assembly 62 passes. When the locking ears 66 are passed axially through the lots 68, the socket assembly 62 is rotated with respect to the wall 70 to move the ears 66 out of axial alignment with the slots 68 against an inboard reference surface 75 on the wall 70 to lock the socket 62 in place on the cap 50. At this point, the inboard surface 77 of the gasket 58 is located in juxtaposed sealing relationship with the outboard surface 78 on the wall 70. The surface 78 defines an axial reference point and the thickness of the wall 70 and the length of the collar 46 are selected, for a predetermined bulb socket assembly 62, to accurately locate a bulb filament 80 at the focal point of the parabolic mirror 18.

A second feature of the present invention is that when the socket 62 is so assembled, the flange 54 is located in radially outwardly located relationship with the outer periphery of the gasket 58 whereby the gasket 58 is shielded by the flange 54 against the entrance of water, dirt, or the like, interiorly of the lamp housing assembly 10.

Figure 3:
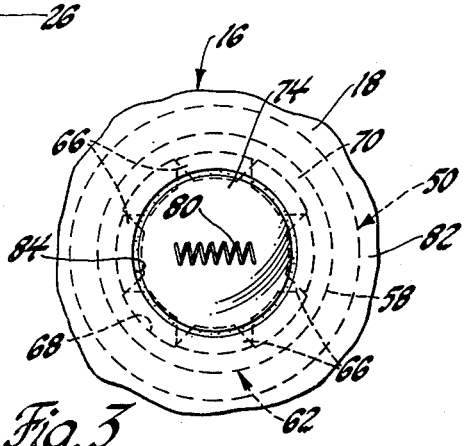
FIG. 3 is a vertical sectional view taken along the line 3—3 of FIG. 2 looking in the direction of the arrows.
Figure 4:
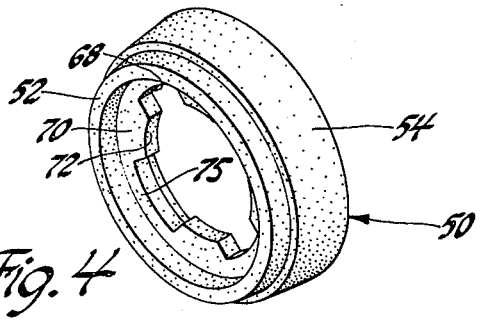
FIG. 4 is a perspective view of a socket mounting cap used in the present invention.

The aforedescribed socket mounting cap 50 in association with an integrally formed rearwardly located collar 46 on the molded parabolic mirror 18 eliminates the need for large cross-section mud-shield regions at the rear thereof. This results in a mold configuration that eliminates heat sinks on the rear of mirror 18. Furthermore, it enables the mold parts to be pulled from the vicinity of a light reflecting surface 82 on the inside of parabolic mirror 18 rightwardly therefrom as shown in FIG. 1. Furthermore, the provision of the mounting cap 50 enables a bulb access opening 84 to be formed in the center rear portion of the parabolic mirror 18 that is of a diameter which is just slightly greater than the maximum outside diameter of the bulb 74. The limited clearance between the access opening 84 and the bulb is illustrated in FIG. 3 and in one preferred embodiment is characterized by the access opening being no more than 10 percent greater than the maximum outside diameter of bulb 74. The access opening 84 area is minimized, by provision of a radially inwardly directed flange or light interception surface 86 on mirror 18. It is formed radially inwardly of the inside diameter of the socket pocket region 48 and defines an annular surface 86 for receiving a cone of light from the bulb 74. The cone of light is reflected from surface 86 thereby to minimize bulb socket losses in the lamp housing assembly 10.

The parabolic mirror 20 is configured to have an integrally formed axially extending rearwardly located collar 88 thereon like collar 46. However, in this case, the length of the collar 88 is greater than that of the collar 46 to maintain a desired light center length when a standard socket mounting cap 90 is supported thereon which has the same dimensional form as the socket mounting cap 50 in the case of parabolic mirror 18. The combination length of the collar 88 and a socket support wall 91 of the mounting cap 90 will locate a filament 92 of a bulb 94 on the focal point of the mirror 20. The bulb 94 is part of a socket bulb assembly 96 like the assembly 62 in FIG. 2. It is retained in the same fashion on the socket mounting cap 90 and includes an outboard flange 98 thereon which serves as a mud shield to a gasket 100 corresponding to gasket 58 of the bulb socket assembly 62. The socket bulb asssembly 96 includes locking ears which are located in socket mounting holes on the cap 90 like those shown in FIGS. 2 and 3.

By virtue of the aforedescribed arrangement of socket mounting caps 50, 90, and collars 46, 86, respectively, a standard socket bulb assembly can be used on mirrors with parabolic focal lengths of a wide range. The greatest benefit of maintenance of light efficiency by virtue of provision of an annular light reflection flange such as 86 shown in FIG. 2 occurs at the shorter focal lengths. Thus, a light interception flange 102 on the mirror 20 is of slightly less area than flange 86 in FIG. 2. However, flange 102 defines a bulb access opening 104 like access opening 84 which has an inside diameter closely proximate to the maximum outside diameter of the bulb 94. By maintaining the bulb clearance difference between the diameter of access openings 84, 104 and the maximum diameter of the bulbs 74, 94, respectively, in a range of less than 10 percent, the reflector efficiency difference is improved over a straight-through opening in the vicinity of a socket mounted directly on the parabolic mirror.

A typical lamp of the present invention, with limited socket lamp access hole light reflection loss, can be formed of a rectangular configuration 1.5 inches × 5.0 inches with a painted reflector. With bulb socket losses at a straight-through opening and painted reflector, the lamp has to be increased to a size of 2.7 inches × 5.0 inches to produce equivalent light output.

While the embodiments of the present invention, as herein disclosed, constitute a preferred form, it is to be understood that other forms might be adopted.

What is claimed is:

1. In a lamp assembly for use with a lamp socket having opposite ends including locking ears on one end thereof and a seal flange with sealing gasket at the opposite end thereof and further including a bulb supported therein having a maximum outside diameter less than the outside diameter of the locking ears and wherein the seal flange has an outside diameter greater than that of the locking ears, the improvement comprising: an integrally molded parabolic mirror having an access opening therein to permit rear insertion of the bulb, an annular light interception surface on said mirror integral therewith and located in surrounding relationship to an inserted bulb, said surface having an inside diameter substantially equal to the maximum outside diameter of the bulb inserted into the lamp access opening, an annular support collar formed integrally of said mirror in surrounding relationship to the access opening and extending axially outwardly thereof, a socket mounting cap having an annular inboard flange supported radially outwardly of the outer end of said collar and being fixedly secured thereto, said mounting cap further including an annular outboad flange, a support wall with an inboard and outboard surface located between said inboard and said outboard flanges having an opening therein including a plurality of circumferentially spaced radially outwardly directed slots formed therein, said slots adapted to receive the locking ears on the socket for relative rotation into interlocking engagement with the inboard surface of the support wall, said outer surface of said support wall defining a reference surface to supportingly receive the sealing gasket of a lamp socket, said support collar and said socket mounting cap having a combined axial length to maintain the bulb at a predetermined light center length from the reference surface to maintain a desired focal length relationship between the bulb filament and the annular light interception surface on said parabolic mirror whereby a cone of generated light from the bulb is intercepted by the preselected annular light interception surface of the mirror for reflection without excessive socket area loss from the lamp assembly.

2. A bulb and socket support for use in a lamp housing having an integrally molded parabolic mirror including a bulb access opening therein and an outwardly extending socket collar the improvement comprising: a radially inwardly directed mirror segment on the integrally formed support collar to define an access opening into the parabolic mirror having an inside diameter less than 10 percent greater than the outside diameter of the bulb inserted therethrough and to define an annular light interception surface for reducing light reflection loss at the access opening into the parbolic mirror, a bulb socket and bulb with sealing gasket having a reference surface, a socket mounting cap supported on the outer end of the support collar including an outboard flange formed continuously around said gasket to define a socket sealing gasket shield at the socket sealing gasket reference surface, the inside diameter of the outboard flange being greater than the outside diameter of the sealing gasket to cover the socket reference surface to prevent ingress of foreign material into the interior of the mirror housing, said mounting cap including a support wall to supportingly receive the socket and an outboard surface to sealingly engage the sealing gasket, the support collar and socket mounting cap support wall maintaining said bulb at a position to locate its filament at a focal length wherein a cone of generated light therefrom will be intercepted by the light interception surface for reflection therefrom to minimize excessive loss of reflector efficiency at the socket support.

3. A method for locating a bulb socket assembly with locking ears on one end and a seal flange on an opposite end at a fixed focal point relationship with respect to an injection molded parabolic mirror of a lamp housing comprising: the steps of forming a bulb access opening in the parabolic mirror having a diameter no greater than 10 percent more than the maximum outside diameter of the bulb, forming an integrally formed support tube on the mirror extending outwardly therefrom, mounting a preformed socket support cap having a support opening on the outer end of said support tube and forming a reference support wall therein to supportingly receive locking ears of the socket and a sealing flange thereon with respect to the parabolic mirror section, selecting a tube length and support wall thickness on said socket support cap to locate a bulb filament at a position where the bulb filament is located at a fixed focal length with respect to the parabolic mirror, forming an annular reflector surface on the mirror in surrounding relationship to the supported bulb having an inside diameter less than that of the support opening in the cap to intercept a generated core of light from the bulb filament for reflection from the mirror to prevent excessive socket area light loss from the reflector.

* * * * *